US008659232B2

(12) United States Patent
Riesebosch

(10) Patent No.: US 8,659,232 B2
(45) Date of Patent: Feb. 25, 2014

(54) VARIABLE-IMPEDANCE LOAD FOR LED LAMPS

(75) Inventor: Scott A. Riesebosch, St. Catharines (CA)

(73) Assignee: CRS Electronics, Ontario (CA)

( * ) Notice: Subject to any disclaimer, the term of this patent is extended or adjusted under 35 U.S.C. 154(b) by 834 days.

(21) Appl. No.: 12/881,776

(22) Filed: Sep. 14, 2010

(65) Prior Publication Data

US 2012/0062141 A1 Mar. 15, 2012

(51) Int. Cl.
*H05B 37/02* (2006.01)

(52) U.S. Cl.
USPC ..... 315/224; 315/209 R; 315/291; 315/307; 315/312

(58) Field of Classification Search
USPC ..... 315/291, 224, 225, 209 R, 307
See application file for complete search history.

(56) References Cited

U.S. PATENT DOCUMENTS

| | | | |
|---|---|---|---|
| 4,694,223 | A | 9/1987 | Campolo |
| 5,101,142 | A | 3/1992 | Chatfield |
| 5,283,516 | A | 2/1994 | Lohoff |
| 5,808,417 | A | 9/1998 | Ference et al. |
| 6,127,784 | A | 10/2000 | Grossman et al. |
| 6,157,135 | A | 12/2000 | Xu et al. |
| 6,424,100 | B1 | 7/2002 | Kominami et al. |
| 6,489,724 | B1 | 12/2002 | Smith et al. |
| 6,642,669 | B1 | 11/2003 | MacAdam et al. |
| 6,674,624 | B2 | 1/2004 | Matsuura |
| 6,762,563 | B2 | 7/2004 | St-Germain et al. |
| 6,831,426 | B2 | 12/2004 | Brevetti et al. |
| 7,230,598 | B2 | 6/2007 | Kawabata et al. |
| 7,265,502 | B1 | 9/2007 | Chou et al. |
| 7,268,674 | B2 | 9/2007 | Bohler et al. |
| 7,321,202 | B2 | 1/2008 | Chitta |
| 7,400,439 | B2 | 7/2008 | Holman |
| 7,436,131 | B2 | 10/2008 | Cottingim et al. |
| 7,502,009 | B2 | 3/2009 | Kang et al. |
| 7,538,499 | B2 | 5/2009 | Ashdown |
| 7,542,257 | B2 | 6/2009 | McCormick et al. |
| 7,595,595 | B2 | 9/2009 | Mehta |
| 8,531,121 | B2 * | 9/2013 | Caldani et al. ..... 315/209 R |
| 2003/0062841 | A1 | 4/2003 | Norling |
| 2003/0151931 | A1 | 8/2003 | Kohno |
| 2006/0017389 | A1 | 1/2006 | Noh |
| 2007/0057902 | A1 | 3/2007 | Joung |
| 2007/0182347 | A1 | 8/2007 | Shteynberg et al. |

(Continued)

FOREIGN PATENT DOCUMENTS

| | | |
|---|---|---|
| CA | 1265185 | 1/1990 |
| EP | 0534793 | 3/1993 |

(Continued)

OTHER PUBLICATIONS

International Search Report and Written Opinion mailed Feb. 22, 2012 for International Application No. PCT/IB2011/002564 (9 pages).

*Primary Examiner* — Tuyet Thi Vo
(74) *Attorney, Agent, or Firm* — Bingham McCutchen LLP

(57) ABSTRACT

In various embodiments, a startup circuit for a low-voltage-lighting electronic transformer includes a low-impedance output circuit. At the beginning of an AC signal cycle, the low-impedance output circuit presents a low-impedance path to the output of the transformer, thereby causing a surge of current in the transformer and initiating oscillation therein.

19 Claims, 4 Drawing Sheets

(56) References Cited

U.S. PATENT DOCUMENTS

| | | | |
|---|---|---|---|
| 2007/0257625 | A1 | 11/2007 | Brison |
| 2008/0094423 | A1 | 4/2008 | Summerland |
| 2008/0258637 | A1 | 10/2008 | Leung |
| 2008/0258647 | A1 | 10/2008 | Scianna |
| 2008/0265799 | A1 | 10/2008 | Sibert |
| 2009/0058313 | A1 | 3/2009 | Chang et al. |
| 2009/0058318 | A1 | 3/2009 | Fukui et al. |
| 2009/0085494 | A1 | 4/2009 | Summerland |
| 2009/0167186 | A1 | 7/2009 | Ghanem |
| 2009/0167210 | A1 | 7/2009 | Nguyen et al. |
| 2009/0251059 | A1 | 10/2009 | Veltman |
| 2010/0085780 | A1 | 4/2010 | Nakai |
| 2010/0096976 | A1 | 4/2010 | Park |

FOREIGN PATENT DOCUMENTS

| | | | |
|---|---|---|---|
| EP | 1752022 | A1 | 2/2007 |
| JP | 4274192 | | 9/1992 |
| JP | 11283758 | | 10/1999 |
| JP | 2009140631 | | 6/2009 |
| WO | WO9400965 | | 1/1994 |
| WO | WO2009027963 | | 3/2009 |

* cited by examiner

VARIABLE-IMPEDANCE LOAD FOR LED LAMPS

TECHNICAL FIELD

Embodiments of the invention generally relate to LED lamps and, more particularly, to circuits for initiating self-oscillation in electronic transformers used in low-voltage-lighting applications.

BACKGROUND

Low-power lamps, such as light-emitting diode ("LED") lamps, may be powered by a low-voltage power supply (e.g., 12 V). A transformer may be used to adapt a high-voltage mains supply (e.g., 120 V) for use with a low-voltage LED lamp. One type of transformer circuit, a self-oscillating transformer, uses a transistor-based bridge to rectify the incoming mains voltage into a half-sine wave, thereby doubling the frequency of the incoming voltage before it is applied to the transformer. The circuit is self-oscillating in the sense that the bridge transistors are controlled by bias voltages created by auxiliary windings of the transformer.

Self-oscillating transformers include startup circuits to initiate oscillation at the beginning of each AC cycle. LED lamps, however, draw such a small amount of power that the transformer startup circuit may fail to cause enough current flow in the transformer to initiate an oscillation. Instead, the bias voltages created by auxiliary windings of the transformer fall toward zero, thereby shutting off control to the bridge transistors. The transformer may get "stuck" in this off position, creating an undesirable interruption in the power to the low-voltage lamp. A need therefore exists for a system that initiates and maintains the self-oscillation of the transformer at start-up.

SUMMARY

In general, various aspects of the systems and methods described herein include a low-impedance load for initiating oscillation in a self-oscillating low-voltage-lighting electronic transformer. Applying the low-impedance load to the output of the transformer at the beginning of an AC signal cycle creates a surge of current in the transformer. This brief surge is enough to bias the transformer control transistors, via the auxiliary windings, to initiate self-oscillation throughout the rest of the AC cycle. Once the transformer begins to oscillate, the low-impedance load may be removed until the beginning of the next AC signal cycle.

In general, in one aspect, a circuit for starting a transformer that powers an LED lamp includes circuitry for presenting a low-impedance path to an output of the transformer during a beginning of an alternating-current (AC) signal cycle. The low-impedance path causes a surge of current in the transformer during the beginning of the AC signal cycle, thereby initiating self-oscillation in the transformer and powering the LED lamp.

In various embodiments, the circuitry removes the low-impedance path during a remainder of the AC signal cycle. The transformer may transform an AC signal to a low-voltage signal, and the AC signal may be a mains voltage and/or a dimmer voltage. The circuitry for presenting the low-impedance path may include a clamp circuit (that may include a capacitor, the charging of which provides the low-impedance path) and/or a transistor-based switch. A sensing circuit may enable the transistor-based switch during the beginning of the AC signal cycle and disable the transistor-based switch during a remainder of the AC signal cycle.

In general, in another aspect, method for initiating self-oscillation in a transformer that powers an LED lamp includes presenting a low-impedance path to the output of the transformer during the beginning of an alternating-current (AC) signal cycle. In response to the low-impedance path, a surge of current is stimulated in the transformer during the beginning of an AC signal cycle, thereby powering the LED lamp.

In various embodiments, the low-impedance path is removed from the output of the transformer during a remainder of the AC signal cycle. The surge of current may be generated at least in part by firing a diac. A self-oscillation may be initiated in the transformer in response to the surge of current, thereby creating a bias voltage in an auxiliary winding of the transformer. The bias voltage may be a feedback control for a transistor bridge in the transformer. Presenting the low-impedance path may include clamping an output voltage of the transformer and/or switching in a low-impedance load at the output of the transformer.

In general, in yet another aspect, an LED lamp circuit for use with a self-oscillating transformer includes an LED lamp connected to an output of the transformer. Circuitry (e.g., a clamp circuit and/or a transistor-based switch) presents a low-impedance path to an output of the transformer during a beginning of an alternating-current (AC) signal cycle. The low-impedance path causes a surge of current in the transformer during the beginning of the AC signal cycle, thereby initiating self-oscillation in the transformer and powering the LED lamp.

BRIEF DESCRIPTION OF THE DRAWINGS

In the drawings, like reference characters generally refer to the same parts throughout the different views. In the following description, various embodiments of the present invention are described with reference to the following drawings, in which.

DETAILED DESCRIPTION

Described herein are various embodiments of methods and systems for a low-impedance load that initiates self-oscillation in a self-oscillating transformer that drives a low-voltage lighting element. The low-impedance load, connected in parallel with the low-voltage lighting element, temporarily provides a low-impedance path to the output of the transformer at the beginning of each AC cycle. The low-impedance load causes a momentary surge of current through the transformer at the beginning of each cycle, thereby jump-starting self-oscillation in the transformer and allowing the transformer circuit to operate normally for the remainder of the cycle.

Figure 1:
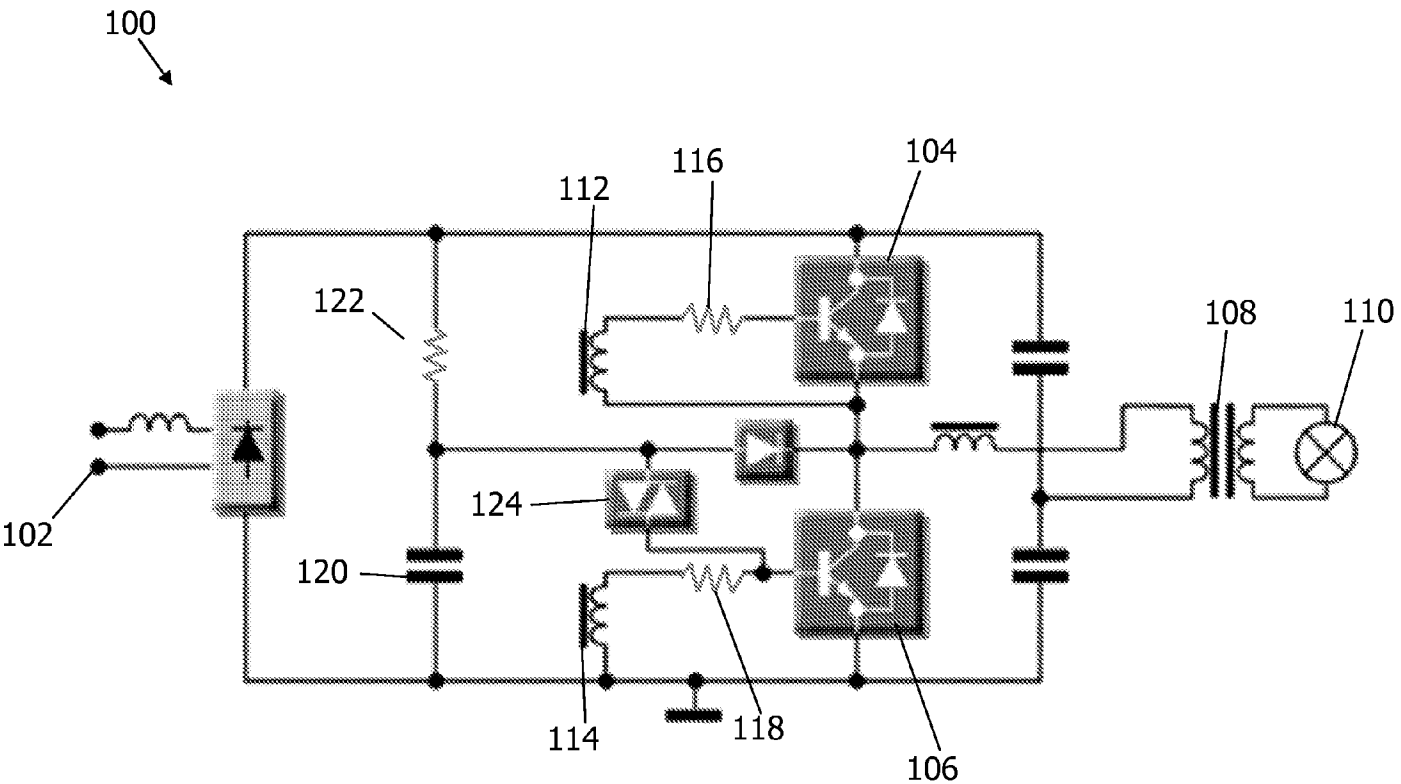
FIG. 1 is a schematic diagram illustrating a self-oscillating transformer with a startup circuit.

FIG. 1 illustrates an exemplary low voltage-lighting-electronic transformer circuit 100 adapted for use with, for example, a halogen lamp. In operation, an AC input signal, such as a 120 V, 60 Hz AC signal, is applied to an input port 102. The AC input signal may be generated by a mains supply, by a dimmer switch, or by any other supply or circuit. This AC signal is rectified and presented to bridge transistors 104, 106 which switch alternately at high frequency to present a high frequency AC signal to a transformer 108. The transformer steps down the voltage to a level appropriate for a lighting element circuit 110 (for example, approximately 12 volts).

The bridge transistors 104, 106 are controlled by auxiliary windings 112, 114 of the transformer 108. As current flows through the transformer 108, it induces a corresponding current and voltage across the auxiliary windings 112, 114. The induced current and voltage may be adjusted with bias resistors 116, 118 to provide a voltage or current level appropriate for the control of the bridge transistors 104, 106. Depending on the polarity of the current in the transformer 108, the auxiliary windings 112, 114 selectively turn on the bridge transistors 104, 106.

At the beginning of each cycle of the input signal's oscillation (i.e., each point at which the input signal begins to deviate from zero), the current in the output transformer 108 is zero, meaning that the current in the auxiliary windings 112, 114 is also zero, and no bias is provided to the bridge transistors 104, 106. At this point, a start-up circuit attempts to initiate current flow in the transformer 108 (when otherwise there would be no current flow).

The start-up circuit includes a startup capacitor 120 that begins to charge when the input voltage applied to the input port 102 rises from zero. A resistor 122 may be added to adjust the time constant of the startup capacitor 120 as necessary. Once the voltage across the startup capacitor 120 is great enough, it will trigger the firing of a diac 124 and attempt to create a sharp increase in current flow through the diac 124. If successful, the increase will bias the lower bridge transistor 106 and cause it to turn on, thereby transmitting the pulse to the input of the transformer 108 and creating a brief pulse in the transformer 108. In one embodiment, the pulse lasts a few microseconds.

As mentioned above, however, an LED lamp consumes much less power than a halogen (or incandescent) lamp. From the point of view of the transformer 100, therefore, an LED lamp may present a high-impedance load. Because of this high-impedance load, the circuit in the transformer 100 may not be able to generate a current surge in the transformer 100 of sufficient magnitude to initiate self-oscillation in the transformer 100.

Figure 2:
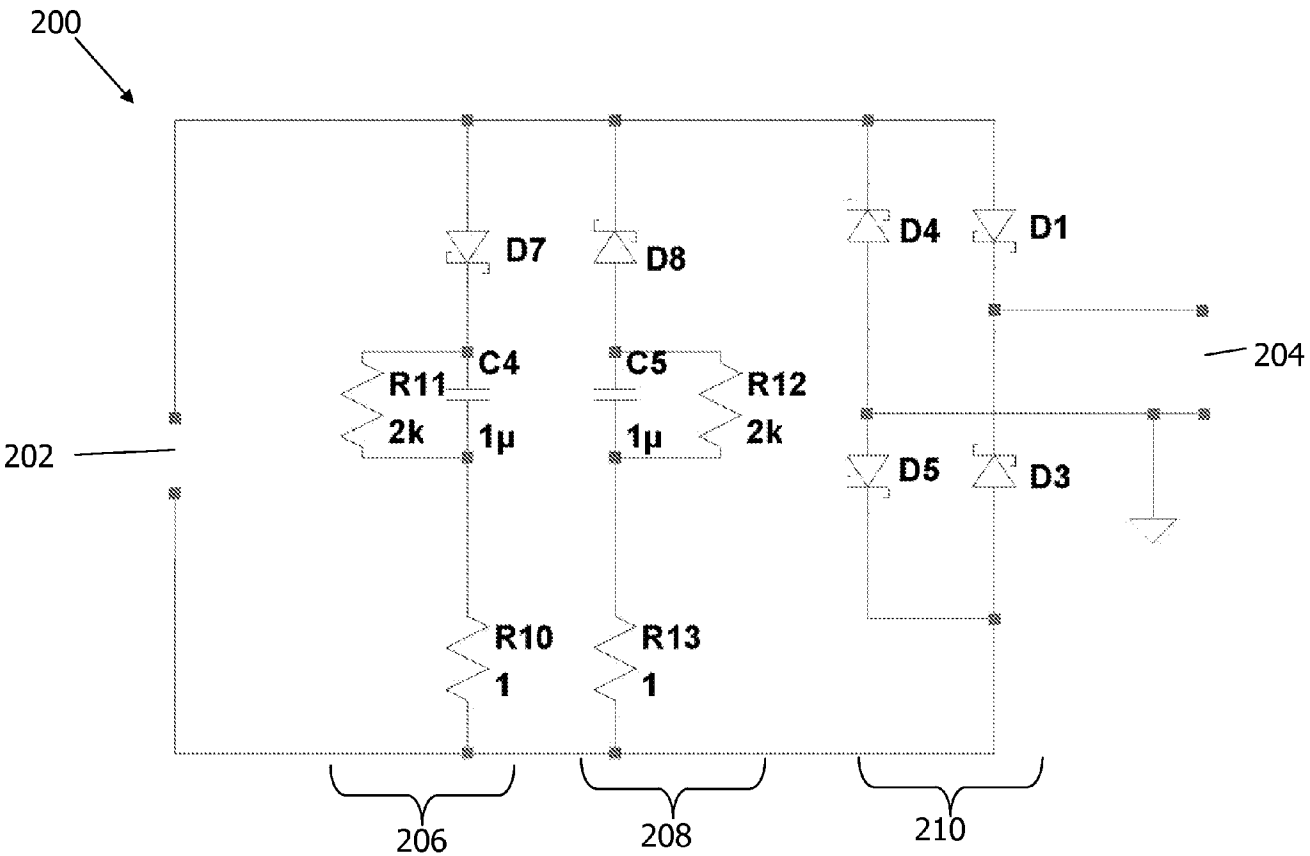
FIG. 2 is a schematic diagram illustrating a low-impedance load circuit for an LED lamp in accordance with an embodiment of the invention.

FIG. 2 illustrates one embodiment of a load circuit 200 (which may be part of the low-voltage-lighting element circuit 110 described above) for temporarily lowering the output impedance seen by the transformer 108. In general, this lowered output impedance absorbs the brief startup pulse, thereby allowing the startup pulse to cause a current surge in the transformer 108 and initiate self-oscillation therein. Once the self-oscillation begins, the lowered impedance may be removed from the output of the transformer 100 and regular operation may continue for the rest of the cycle. The circuit 200 includes an input port 202 for receiving the output of the transformer 108 and an output port 204 for driving the low-voltage-lighting element. The circuit further includes first and second clamp circuits 206, 208 and a bridge rectifier 210. Although the bridge rectifier 210 is depicted to the right of the clamp circuits 206, 208 (i.e., on the output side), it may instead be connected on the left (i.e., on the input side). In this embodiment, only one clamp circuit 206, 208 may be needed because there is no dual polarity to account for after the signal has passed through the bridge rectifier 210. The bridge rectifier 210 may include diodes D1, D3, D4, D5, as pictured, or may be implemented with four MOSFET devices.

Clamp 206 includes elements C4, D7, R10, and R11 for clamping a first half of the incoming AC waveform having a first polarity (e.g., positive), and clamp 208 includes elements C5, D8, R12, and R13 for clamping a second half having a second polarity opposite the first polarity (e.g., negative). When a cycle of the transformer 108 output signal begins, the voltages across the capacitors C4, C5 are zero or nearly zero, having been discharged through resistors R11, R12 during the end of the previous cycle. When the diac 124 fires, as described above, it instigates a pulse in the transformer 108. The output 202 of the transformer 108, including the small pulse, is applied across the clamps 206, 208. Depending on the polarity of the pulse, the pulse begins to charge either capacitor C4 (through diode D7) or capacitor C5 (through diode D8). Thus, the capacitors C4, C5 temporarily provide a low-impedance path for the output 202 of the transformer 108.

The time constants of the capacitor/resistor pairs C4/R11 and C5/R12 are such that the duration of the surge current is brief relative to the entire cycle (e.g., approximately a few microseconds versus a 120 Hz cycle). The discharge cycle may be considerably longer, however, so that capacitors C4, C5 are not continually discharging at the high switching frequency of the transformer (typically 20 kHz and above). When the incoming waveform returns to zero, however, the capacitors C4, C5 may be fully or nearly fully discharged. The values of resistors R10 and R13 may be small to limit the inrush current to a suitable amount; in another embodiment, resistors R10 and R13 are not present at all.

Figure 3:
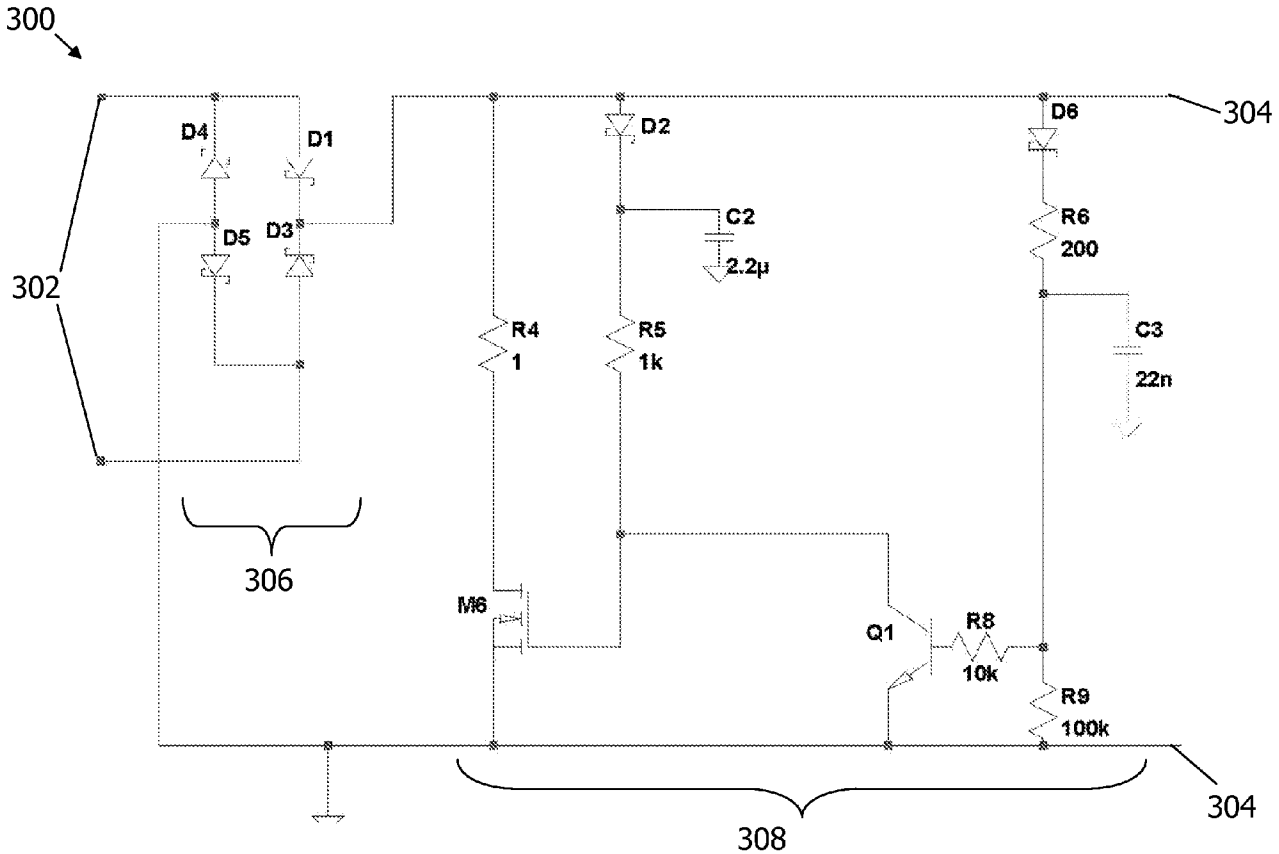
FIG. 3 is a schematic diagram illustrating another low-impedance load circuit for an LED lamp in accordance with an embodiment of the invention.

FIG. 3 illustrates an alternative load circuit 300 that temporarily lowers the output impedance seen by the transformer 108. Like the circuit described above, the output circuit 300 includes an input port 302 for receiving the output of the transformer 108 and provides an output port 304 for driving the low-voltage-lighting element. Diodes D1, D3, D4, and D5 form a bridge rectifier 306, and, as above, may be MOSFET devices instead of diodes. An impedance control circuit 308 receives the output of the bridge rectifier 306 and provides the low-impedance path for the transformer 108.

In one embodiment, the impedance control circuit 308 operates as follows. In general, transistor M6 acts as a switch, turning on to present resistor R4 as a low-impedance output to the transformer 108 at the beginning of a cycle, and turning off during the remainder of the cycle. The rest of the impedance control circuit senses the beginning of a new cycle and provides a control signal to transistor M6 as appropriate.

More specifically, at the beginning of a new cycle, a capacitor C2 remains charged from the previous cycle. When the output of the bridge rectifier 306 approaches zero, capacitor C3 will discharge through resistor R9, thereby lowering the base voltage of transistor Q1 and turning that device off. When transistor Q1 switches off, capacitor C2 no longer has a low-impedance path along which to discharge, and a gate voltage builds across transistor M6. Once capacitor C2 has charged the gate of transistor M6 sufficiently high, that transistor will turn on. Resistor R4 and the channel of transistor M6 will therefore act as a shunt across the output of the bridge rectifier 306. The pulse from the transformer 108 instigated by the diac 124 travels through the bridge rectifier 306 and sees the low-impedance load created by resistor R4 and transistor M6. As described above, the combination of the generated pulse and the low-impedance load encourages the transformer 108 to begin oscillating. As the transformer 108 oscillates and delivers more voltage, a charge builds on capacitor C3 at a pre-determined rate set by resistor R6. The RC time constant set by capacitor C3 and resistor R6 causes a delay in turning on transistor Q1. After the delay (e.g., approximately a few microseconds), a sufficiently large voltage builds across the base of transistor Q1 and it turns on, thereby shorting out the gate drive of transistor M6. Once transistor M6 turns off, its now high-impedance channel effectively removes resistor R4 from the circuit 300. Once resistor R4 and its associated low-impedance path is removed, the transformer 108 may drive the LED replacement lamp with no further intervention until the input waveform again approaches zero, at which time the cycle repeats.

Figure 4:
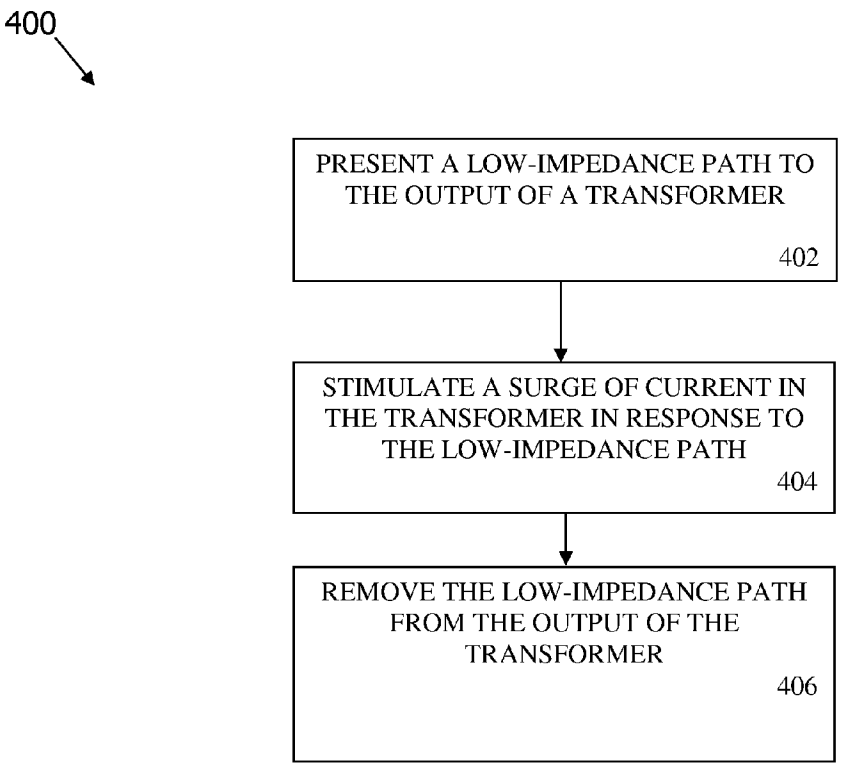
FIG. 4 is a flowchart illustrating a method for initiating oscillation in a self-oscillating transformer with a low-impedance load in accordance with an embodiment of the invention.

FIG. 4 illustrates a method 400 for starting oscillation in a self-oscillating transformer using a low-impedance load in accordance with an embodiment of the invention. As described above, a low-impedance path is presented to the output of the transformer during the beginning of an AC signal cycle (Step 402). The low-impedance path may be produced by, for example, the load circuits 200, 300 described above. The low-impedance path stimulates a surge of current in the transformer during the beginning of an AC signal cycle (Step 404). The surge of current may be initiated by a diac or any other pulse-generating circuit or circuit element known in the art, as described above. The timing of the pulse and of the presentation of the low-impedance path may exactly or partially coincide. In one embodiment, a sensing circuit senses when a power level in the transformer falls below a threshold (e.g., at or near zero volts) and lowers the impedance of the path accordingly. In another embodiment, the sensing circuit senses when the transformer start-up circuit emits, or is about to emit, the start-up pulse. The surge of current may initiate a self-oscillation in the transformer, which may be fed back to the input of the transformer and used as a bias signal. The low-impedance path may be removed from the output of the transformer during the remainder of the AC signal cycle (Step 406).

Certain embodiments of the present invention were described above. It is, however, expressly noted that the present invention is not limited to those embodiments, but rather the intention is that additions and modifications to what was expressly described herein are also included within the scope of the invention. Moreover, it is to be understood that the features of the various embodiments described herein were not mutually exclusive and can exist in various combinations and permutations, even if such combinations or permutations were not made express herein, without departing from the spirit and scope of the invention. In fact, variations, modifications, and other implementations of what was described herein will occur to those of ordinary skill in the art without departing from the spirit and the scope of the invention. As such, the invention is not to be defined only by the preceding illustrative description.

What is claimed is:

1. A circuit for starting a transformer that powers an LED lamp, the circuit comprising:

circuitry for presenting a low-impedance path to an output of the transformer during a beginning of an alternating-current (AC) signal cycle, wherein the low-impedance path causes a surge of current in the transformer during the beginning of the AC signal cycle, thereby initiating self-oscillation in the transformer and powering the LED lamp.

2. The circuit of claim 1, wherein the transformer transforms an AC signal to a low-voltage signal.

3. The circuit of claim 1, wherein the circuitry removes the low-impedance path during a remainder of the AC signal cycle.

4. The circuit of claim 3, wherein the AC signal is at least one of a mains voltage or a dimmer voltage.

5. The circuit of claim 1, wherein the circuitry for presenting the low-impedance path comprises a clamp circuit.

6. The circuit of claim 5, wherein the clamp circuit comprises a capacitor, the charging of which provides the low-impedance path.

7. The circuit of claim 1, wherein the circuitry for presenting the low-impedance path comprises a transistor-based switch.

8. The circuit of claim 7, further comprising a sensing circuit for enabling the transistor-based switch during the beginning of the AC signal cycle and disabling the transistor-based switch during a remainder of the AC signal cycle.

9. A method for initiating self-oscillation in a transformer that powers an LED lamp, the method comprising:

presenting a low-impedance path to the output of the transformer during the beginning of an alternating-current (AC) signal cycle; and stimulating a surge of current in the transformer during the beginning of an AC signal cycle in response to the low-impedance path, thereby powering the LED lamp.

10. The method of claim 9, further comprising removing the low-impedance path from the output of the transformer during a remainder of the AC signal cycle.

11. The method of claim 9, wherein the surge of current is generated at least in part by firing a diac.

12. The method of claim 9, wherein presenting the low-impedance path comprises clamping an output voltage of the transformer.

13. The method of claim 9, wherein presenting the low-impedance path comprises switching in a low-impedance load at the output of the transformer.

14. The method of claim 9, further comprising initiating a self-oscillation in the transformer in response to the surge of current.

15. The method of claim 14, wherein the self-oscillation in the transformer creates a bias voltage in an auxiliary winding of the transformer.

16. The method of claim 15, wherein the bias voltage is a feedback control for a transistor bridge in the transformer.

17. An LED lamp circuit for use with a self-oscillating transformer, the LED lamp circuit comprising:

an LED lamp connected to an output of the transformer; and circuitry for presenting a low-impedance path to an output of the transformer during a beginning of an alternating-current (AC) signal cycle, wherein the low-impedance path causes a surge of current in the transformer during the beginning of the AC signal cycle, thereby initiating self-oscillation in the transformer and powering the LED lamp.

18. The circuit of claim 17, wherein the circuitry comprises a clamp circuit.

19. The circuit of claim 17, wherein the circuitry comprises a transistor-based switch.

* * * * *